US005150535A

United States Patent [19]

Fleissneer

[11] Patent Number: 5,150,535

[45] Date of Patent: Sep. 29, 1992

[54] AIR MIXER APPARATUS

[76] Inventor: Gerold Fleissneer, Aspermontstr. 28, Chur CH-7000, Switzerland

[21] Appl. No.: 591,366

[22] Filed: Oct. 1, 1990

[30] Foreign Application Priority Data

Sep. 30, 1989 [DE] Fed. Rep. of Germany ..... 3932837

[51] Int. Cl.[5] ..... F26B 13/00

[52] U.S. Cl. ..... 34/155; 34/115; 431/353

[58] Field of Search ..... 432/222, 223; 431/353, 431/158; 34/22, 218, 210, 155, 115

[56] References Cited

U.S. PATENT DOCUMENTS 3,796,209 3/1974 Luft ..... 431/353 X 3,799,734 3/1974 Bailey ..... 431/353

*Primary Examiner*—Henry A. Bennet

*Attorney, Agent, or Firm*—Antonelli, Terry, Stout & Kraus

[57] ABSTRACT

Dryers with gas heating present a special problem, namely the uniform mixing of the combustion gases produced by a gas burner with circulated treatment air. In order to attain this objective, a special structure of an air mixer is provided, consisting of three series-arranged sections of air directing plates. In each section, of a different structure, the treatment air is in each case rerouted or deflected toward the middle of the treatment duct and mixed during this process with the air currents coming from the sides. It is advantageous to generate vortices in each case, first by means of a funnel-shaped air mixing section and then by means of sections with mutually parallel-arranged plates which are, on the one hand, disposed perpendicularly and, on the other hand, transversely thereto.

12 Claims, 1 Drawing Sheet

AIR MIXER APPARATUS

This invention relates to an apparatus including an air mixer located in the flow direction of an at least partially heated air stream in front of a heat treatment chamber, for example for drying lengths of textile material, and provided for mixing air strata present in this air stream and having differing temperatures, this air mixer comprising air deflection and turbulence-generating devices arranged in a flow duct for the air stream.

An apparatus for the uniform distribution of air has been known, for example, from German Patent 1,153,872. However, this apparatus serves for the air conditioning of rooms which, without substantial draft phenomena, are to be ventilated with warm heating air. For this purpose, air outlets are provided perpendicularly to the flow duct, these outlets terminating into a vortex chamber from which the air flow exits laterally in spiral shape. Such structures are unsuitable for obtaining uniform temperature in previously heated air volumes. This also holds true for the device according to U.S. Pat. No. 3,854,386 wherein perpendicularly arranged strips are mounted on an annular disk comparable to a circular disk, making it possible to divide the inlet air stream into radial individual jets. These pivotable strips could also be provided in the flow duct for the air intermixing, but such strips would merely be able to subdivide the air streams into individual jets. A satisfactory intermixing of the thermal strata cannot be obtained. Similar considerations apply with regard to the devices according to U.S. Pat. No. 2,791,170 wherein the inlet air stream is likewise divided into individual jets by means of radially arranged webs; the latter can also be located in the air stream inclined with respect to one another in order to generate vortices.

Starting with a device of the type discussed hereinabove, the invention is based on the object of developing an air mixer apparatus capable of intermixing hot and cooler air strata, namely, for example, on the way to a heat treatment chamber wherein only a uniformly heated volume of air is then to be available for the heat treatment of lengths of material, e.g., textile material.

In order to attain the thus-posed object, the invention provides that several mutually parallel-arranged air re-routing or deflecting plates are disposed over the entire cross section of a flow duct, i.e. perpendicularly to the flow direction; these plates extending in the flow direction of the air duct and being uniformly inclined over the whole cross section of the flow duct. If, advantageously, the inclination of the plates is oriented so that the air is blown toward the middle of the duct, then a plurality of individual air jets will converge at that location at which the jets are then mixed together.

It is especially advantageous to construct the air mixer of individual series-arranged parts or sections, and to provide that these air mixer parts guide the air respectively into a different direction. One aspect of the invention in this context is, for example, to align the plates of the neighboring air mixer parts perpendicularly with respect to one another and to guide the air flow in each case into the middle or center of the duct. It is also possible to guide the air into the middle by means of circularly arranged plates which in each case are inclined toward the center, and to intermix the air in the middle with other streams.

It proved to be especially advantageous to make the air mixer of three series-arranged parts or sections wherein the first section should consist of circularly arranged plates which—as mentioned herein—must be conically disposed in order to guide the air into the middle of the duct. Subsequently, merely parallel-disposed plates should be provided in the second section, but these are in turn, oriented toward one another in their inclination. A third section is then located with its plates perpendicularly arranged with respect to the preceding part resulting, in the final analysis, in a complete intermixing of the air currents without any vestige of thermal schlieren or strata.

The accompanying drawings illustrate one embodiment of the device according to this invention. In the drawing.

Figure 3:
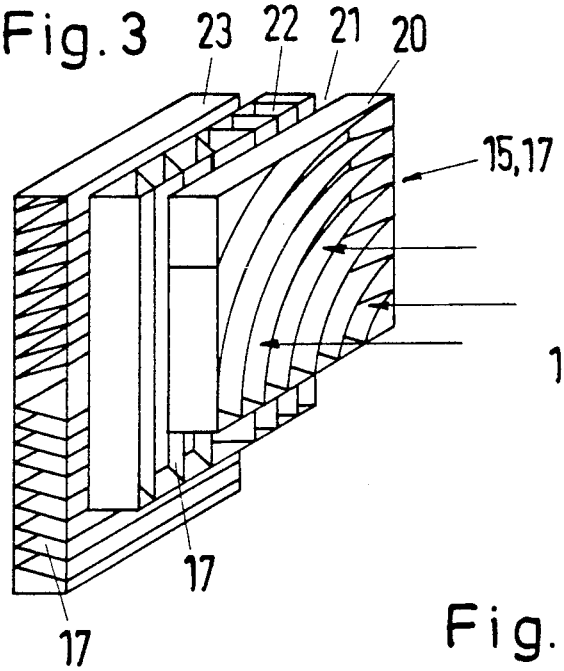
FIG. 3 is a perspective illustration of the air mixer according to FIG. 2 with the three series-arranged air mixing sections.

The air mixer according to this invention has a great variety of applications. The mixer is capable of intermixing air strata with extremely differing temperatures. In the illustrated embodiment, a flowthrough dryer is shown, the structure of this air mixer is to be described in greater detail with reference thereto.

As is known, a flowthrough or sieve drum dryer consists of a housing 1 closed all around and equipped with an inlet and an outlet; this housing being subdivided by a vertical partition 2 into a treatment chamber 3 and a fan chamber 4. The fan chamber 4 can also be provided independently of the housing 1; as a consequence, the bearings of the sieve drum 5 rotatably supported in the treatment chamber 3 need not be located within the hot atmosphere. A screen fabric or perforated metal sheet, not shown in the drawing, is generally placed on the sieve drum 5, which is advantageous for a more uniform contact of the textile material 6. In the circumferential zone not covered by the textile material 6 on the sieve drum, the sieve drum 5 is shielded on the inside against the suction draft by means of a cover 7. The cover is herein illustrated at a location on which the textile material is likewise disposed on the sieve drum, which insofar represents a contradiction. The cover in this arrangement is to be offset by angular degrees. A screen cover 8 is arranged in the treatment chamber 3 above and below the sieve drum and sieves for producing an accumulation of air in order to make the air streams flowing toward the sieve drum 5 uniform. The radial fan 9 is rotatably supported in the fan chamber 4 and places the inside of the sieve drum 5 under a suction draft and accelerates the treatment air upwardly for regeneration in a heating unit 10.

Figure 1:
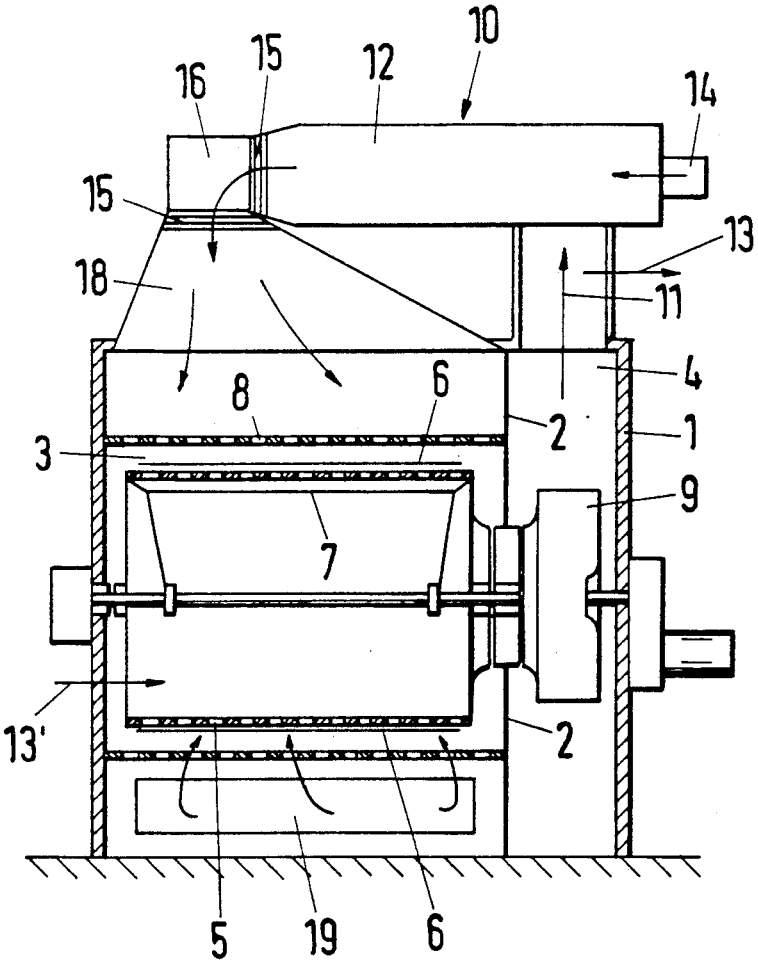
FIG. 1 shows a view partially in section taken transversely through a flowthrough dryer having a burner on its topside wherein the circulating air is mixed with fresh incoming heating gases by an air mixer device or section.

The circulated treatment air must be accelerated as well as heated up after each throughflow process. In the example of FIG. 1, a direct gas heater 14 is provided for this purpose. Depending on the structure of the drum and also its size, air volumes must be processed here which can no longer be heated up by means of a heater within the housing 1. With the flow-through drum constructions customary in this connection, about 100 $m^3$ of air per second must be heated up, the temperature demanded to be ambient at the textile material 6 ranging between 120° and 300° C. However, the heating gases which heat this recirculated treatment air have a temperature of between 800° and 900° C. Therefore, considerable effort is involved in distributing these hot combustion gases uniformly with the circulated treatment air.

In the illustrated example, the circulation air, accelerated by the fan 9 in the upward direction as per arrow 11, flows toward the air flow duct 12. On the pressure side, a certain amount of waste air, illustrated by the arrow 13, is to be removed from the circulation; whereas, fresh air 13' is introduced into the fan 9 on the vacuum side. The combustion gases produced by the burner 14 are mixed in duct 12 with the circulated air accelerated in fan 9. On account of the high temperature differences, special efforts must be expended for mixing the differently heated air streams with one another. For this purpose, in accordance with the illustrated structure, an air mixer 15 is required which can be located at the end of the duct 12 shortly upstream of the rectangular elbow 16 and/or downstream thereof. After the intensive intermixing of the individual air components which takes place therein, the uniformly heated air then flows via a duct 18 to the topside of the sieve drum or via the duct 19 to the underside of the sieve drum.

Figure 2:
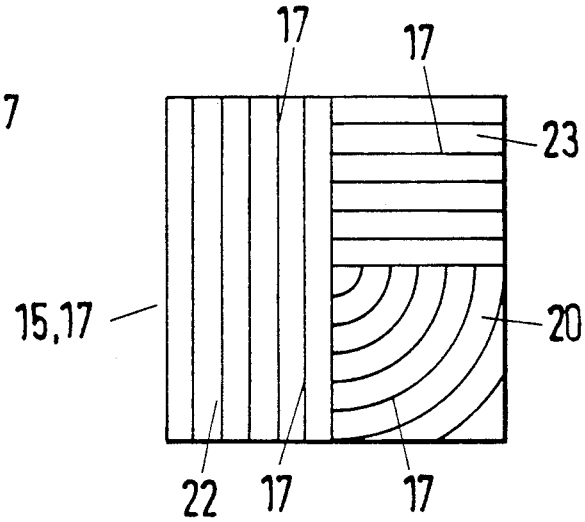
FIG. 2 is a top view of the air mixer with three differing baffle orientations which are only partially visible.

The air mixer 15 according to FIGS. 2 and 3 consists of several air deflecting and turbulence-generating devices located in an air duct. In order to produce uniform mixing of the air streams, a plurality of plates 17 extending in the flow direction is arranged transversely across the entire flow duct 12; these plates are inclined in the flow direction, so that the respective plates 17 are in each case oriented toward the middle of the flow duct 12. As a result, the air is blown on one half of the duct toward the left to the middle and on the other half of the duct the air is blown toward the right to the middle, or in a subsequent air mixing section from the top toward the bottom and from the bottom toward the top. In a third possibility, the plates 17 are arranged in a circle and oriented in a funnel shape. Thereby, the air is again displaced into the middle or center of the flow duct so that the respective air streams of all sides converge at that location in the middle.

It proved to be advantageous to arrange the air mixer parts in triple series succession. In the illustrated embodiment, first the circular part or section is provided for this purpose in the air flow direction (shown by arrows in FIG. 3), where the plates blow the air in a funnel shape into the center of the flow duct. At a short spacing or distance 21, a part or section 22 then follows, the plates of which are oriented in parallel and transversely to the direction of gas flow (vertically in accordance with FIGS. 2 and 3), blowing the treatment air in each case toward the middle of the treatment duct on account of the differing plate inclinations. The third part 23 of the air mixer likewise exhibits plates arranged mutually in parallel and inclined toward the middle, but their orientation is perpendicularly with respect to the plates in air mixing section 22 so that again a renewed rerouting of the treatment air and thus intensive mixing are achieved.

What is claimed is:

1. An apparatus comprising an air mixer arranged in the flow direction of an at least partially heated air stream within an air flow duct in front of a heat chamber, for drying lengths of textile material, and provided for mixing air strata of differing temperatures present in the air stream, said air mixer comprising a plurality of air deflection and turbulence generating sections arranged in series in the flow duct, characterized in that in each section several mutually parallel-arranged air deflecting plates are arranged to extend over the entire cross section of the flow duct.

2. An apparatus according to claim 1, characterized in that said plates extend in the flow direction and are inclined with respect to this flow direction over the entire cross section of the flow duct.

3. An apparatus according to claim 1 or 2, characterized in that at least half of the plates are inclined by the same angle over the entire cross section of the flow duct.

4. An apparatus according to claim 3, characterized in that the area of at least one section of the air mixer is centrally subdivided into two halves with respect to the inclination of the plates, and the two halves exhibit plates inclined, respectively, toward the middle of the flow duct.

5. An apparatus according to claim 3, characterized in that the plates in one section are arranged in a circular shape, with the inclination being in a funnel shape, over the cross section of the air mixer and are inclined toward the center of the flow duct.

6. An apparatus according to claim 1, characterized in that the air mixer comprises two sections of plates arranged in series.

7. An apparatus according to claim 6, characterized in that the air mixer comprises three sections of plates arranged in series.

8. An apparatus according to claim 6 or 7, characterized in that the plates of the series-arranged air mixing sections exhibit differing inclinations.

9. An apparatus according to claim 8, characterized in that the plates of at least two of the series-arranged air mixing sections are disposed perpendicularly to one another.

10. An apparatus according to claim 7, characterized in that, in the flow direction of the air to be intermixed, first a circular section of the air mixer is located and then at a short distance a second section with mutually parallel-arranged plates respectively inclined toward the middle is provided, followed, in turn, in the flow direction, at a short distance, by a third section, the plates of which are oriented perpendicularly with respect to the section located upstream thereof.

11. An air mixing apparatus comprising several mutually parallel-arranged air deflecting plates arranged in an air duct, said plates having a width extending in the direction of an air flow within the duct and a length extending across the width of the air duct so that the plates extend over the entire cross section of the air duct, and said plates being inclined with respect to the axial direction of flow of the air through the air duct so that the air is deflected towards the middle of the air duct of the air mixing apparatus.

12. An air mixing apparatus according to claim 11, wherein a plurality of series-arranged sections of said several mutually parallel-arranged air deflecting plates are arranged closely adjacent in said air flow duct, at least two of the series-arranged sections each having plates which are disposed perpendicularly to the plates of an adjacent section.

* * * * *